United States Patent [19]

Cremer

[11] 4,241,598

[45] Dec. 30, 1980

[54] METHOD FOR PRODUCING A CROSS-SLOTTED HEADING DIE

[75] Inventor: Kurt H. L. Cremer, Ratingen, Fed. Rep. of Germany

[73] Assignee: Sack & Kiesselbach Maschinenfabrik GmbH, Duesseldorf

[21] Appl. No.: 951,633

[22] Filed: Oct. 16, 1978

[51] Int. Cl.[3] ..... B21D 22/00

[52] U.S. Cl. ..... 72/354; 72/359; 72/374; 72/376; 72/377; 76/107 R

[58] Field of Search ..... 72/354, 360, 359, 374, 72/376, 377; 76/107 R

[56] References Cited

U.S. PATENT DOCUMENTS

| | | | |
|---|---|---|---|
| 2,066,372 | 1/1937 | Tomalis | 76/107 R |
| 2,140,670 | 12/1938 | Donbeck | 76/67 R X |
| 2,417,569 | 3/1947 | Rice | 72/374 X |
| 2,633,765 | 4/1953 | Glasner | 72/354 |
| 2,699,693 | 1/1955 | Stellin | 76/107 R |
| 3,650,163 | 3/1972 | Juffs | 76/107 R |

*Primary Examiner*—Leon Gilden

*Attorney, Agent, or Firm*—John J. Dennemeyer

[57] ABSTRACT

A method and apparatus are provided for producing a cross-slotted die for forming cross-slotted screw heads. One end face of a cylindrical blank is turned to form a cone having a cone angle of between 124° and 140°. The cross shape is produced in this face by a single cold forming stage while preserving the outer diameter of the blank. The blank is held in a cylindrical holder having a bore with an internal diameter corresponding to the diameter of the cylindrical blank. An ejection mandrel engages in the bore to form the base of the holder. A platen carries a punch for insertion into the bore to deform the end face of the blank.

2 Claims, 4 Drawing Figures

METHOD FOR PRODUCING A CROSS-SLOTTED HEADING DIE

Figures 1, 4:
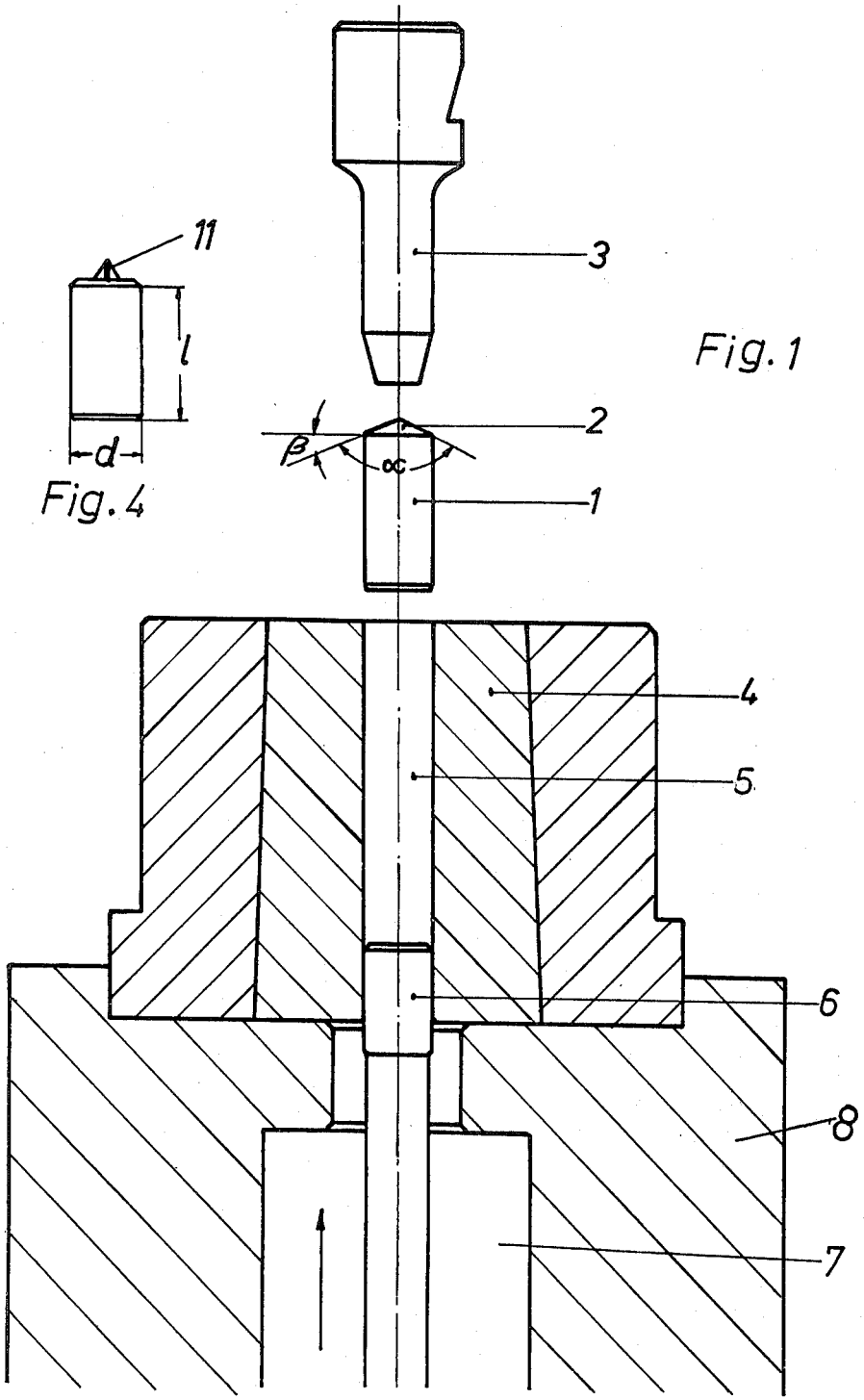

The invention relates to a method for producing a cross-slotted heading die for processing cross-slotted screw heads, starting from a cylindrical blank on one end face of which the cross shape is formed by means of a punch.

In the methods normally used for producing such cross-slotted heading dies, the dies are produced by pressing the blank in several stages, in order to be able to maintain the desired shape and dimensions in a cross-slotted heading die. The die blanks which are free inside the holder are thus pressed into shape between the pressure plates of a press. Therefore, it is frequently impossible to prevent warping of the material and the production of inaccurate shapes as regards the length and diameter of the cross-slotted heading die.

In order to be able to remove the cross-slotted heading die in presently used methods, the holder must be rotated and placed below a tubular member, and the die must then be pushed out with a separate mandrel.

The object of the invention is to eliminate the said drawbacks and to facilitate the production in particular of cross-slotted heading dies with the exact desired shape and dimensions in a single stage.

This object is fulfilled according to the invention due to the fact that, on its end face to be deformed, the blank comprises a flat cone produced by turning, with a cone angle of between 124° , and 140° and the formation of the cross shape takes place in a single stage under cold conditions, whilst preserving the outer diameter of the blank. According to a further proposal of the invention, the cross shape is formed at a pressing speed of 4 mm/sec. to 4.5 mm/sec. According to one embodiment of the invention, the apparatus for carrying out the method comprises a holder for the blank, which is provided with a bore corresponding to the diameter of the cylindrical blank, whereby the blank of predetermined length inserted in the bore comes to bear at one end by its flat end face on an ejector mandrel fitted in the bore and forming the base of the holder, and at the other end the punch fixed in the upper pressure plate and projecting into the bore of the holder comes to bear against the turned flat cone of the blank.

Upon using the method according to the invention with the afore-described apparatus, it is possible for the blank to be provided with the desired cross shape for the cross-slot of a screw by a pressing operation having a single stage, since the blank is held firmly and with a secure position in the bore of the holder, enclosed between the ejector mandrel forming the base and the punch fixed in the upper pressure plate. During the subsequent pressing stroke, the punch penetrates the material of the flat cone of the blank and deforms the cone to produce the desired cross-slot, in which case the material is compressed—which provides an increase in the tool life of the cross-slotted heading die—and is given the exact desired length. Furthermore, securing the position of the blank in the holder bore allows no further deformation of the blank. It has thus been found that the cross shape can be produced in an optimum manner if the angle of the turned flat cone on the blank is within the given range of 124° to 140° . In each individual case, the exact angle of the cone depends on the specific type which is to be produced. The types, which are fixed according to the dimensions of the cross-slot, range from 0 to 4. The same method is also useful for the production of the polygonal heading dies.

Figure 2:
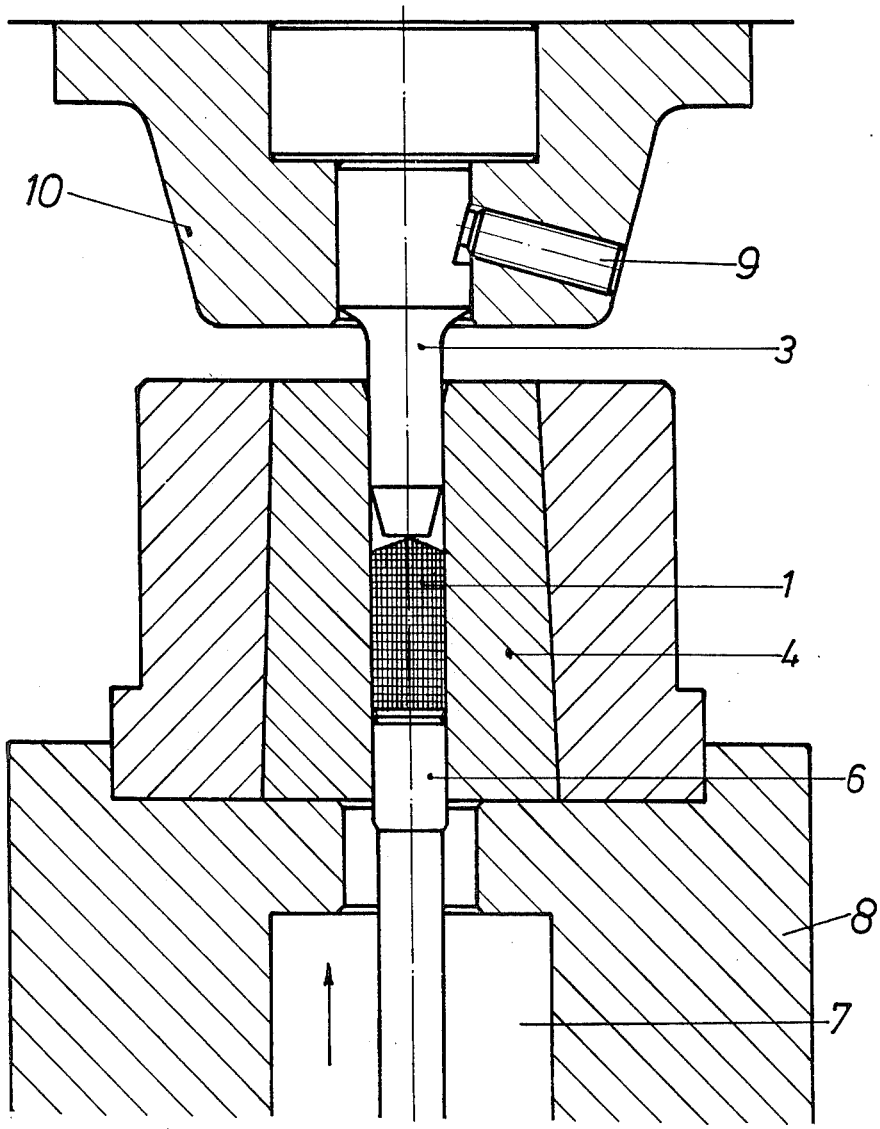
Figure 3:
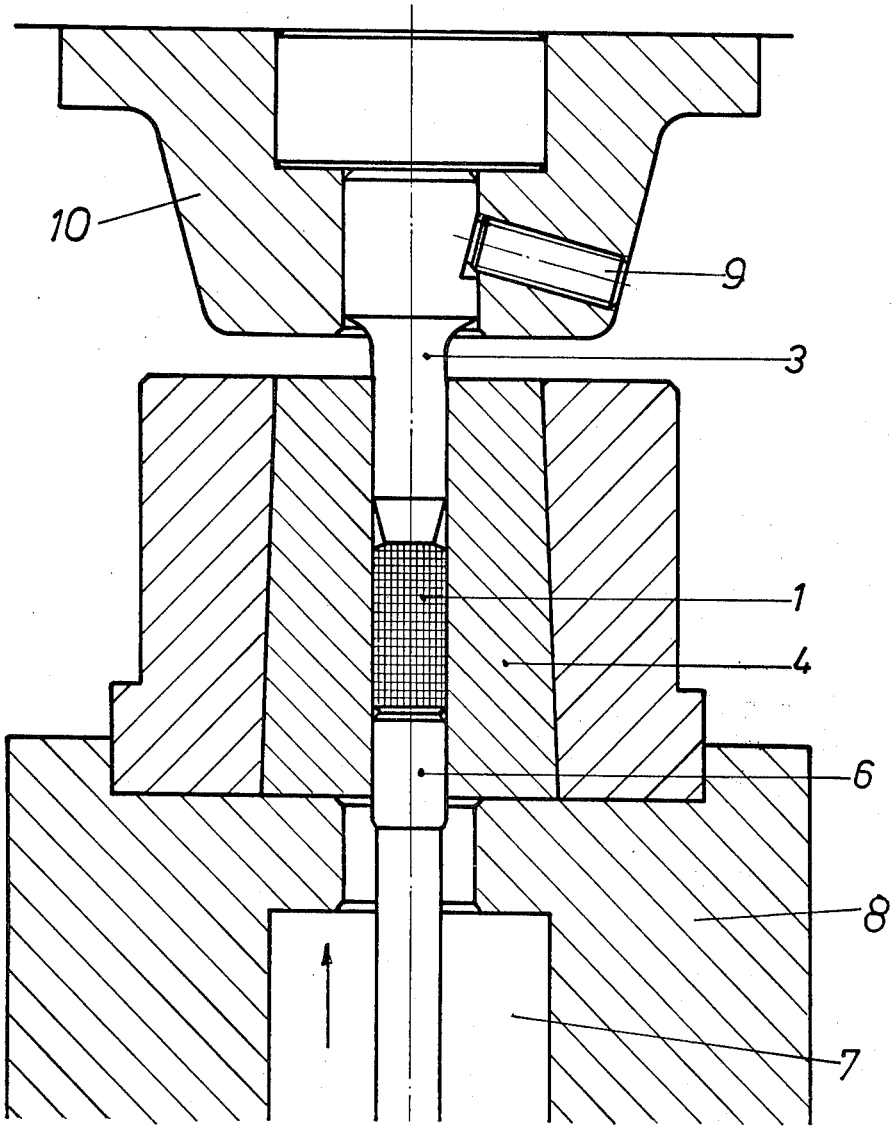

One embodiment of the invention is illustrated in the drawings and described in detail hereafter:

FIG. 1 is a vertical section showing the parts necessary for carrying out the method, FIG. 2 is a vertical sectional view with the parts according to FIG. 1 shown in their initial position, FIG. 3 is a view according to FIG. 2 with the parts of FIG. 1 shown in their final position, and FIG. 4 shows the finished cross-slotted heading die.

FIG. 1 shows that the initial material for the subsequent cross-slotted heading die is a cylindrical blank 1 with a flat cone 2 formed on one end thereof, the angle of the cone $\alpha$ being between 124° and 140° or the angle $\beta$ being between 20° and 28° . The punch 3 is pressed into the flat cone 2 to form the desired cross shape. The blank 1 and punch 3 are introduced into the bore 5 in the holder 4. The blank 1 comes to bear by its flat end face on the base of the holder 4. The base is formed by an ejector mandrel 6 fitted in the bore 5. The ejector mandrel 6 itself may be moved in the direction of the arrow by being acted upon by a piston (not shown in detail), which is located in a bore 7 in the lower pressure plate 8, which also serves for mounting the holder 4.

FIG. 2 shows the initial position of the parts just before pressing. The blank 1 is located in the bore 5 of the holder 4 between the ejector mandrel 6 and the punch 3 introduced into the bore. The said parts all have the same outer diameter. The punch 3 is mounted in the upper pressure plate 10 of the press by means of a securing screw 9. Pressing is effected against the ejector mandrel 6, in that an axial pressure is exerted in the vertical direction on the punch 3 and thus on the flat cone 2 of the blank 1. Due to the axial pressure, the punch 3 penetrates the material and deforms the latter with simultaneous compression. FIG. 3 shows this final position. The radial forces occurring are constant and have no harmful effect.

When the pressing operation is terminated, the upper pressure plate 10 with the punch 3 is moved out of the bore 5 of the holder 4. The ejector mandrel 6 may then be actuated by being acted upon by the piston (not shown) and the shaped cross-slotted heading die can be ejected. The ejection stroke is limited by the bore 7 in the lower pressure plate 8. In addition to the fact that the desired diameter d of the heading die has been maintained along with obtaining the exact desired die length l, the cross-slotted heading die (FIG. 4) produced in this way also has optimum shaping accuracy of the cross-slot 11.

What is claimed is:

1. A method of producing a cross-slotted heading die for forming cross-slotted screw heads, including the steps of:

preparing a cylindrical blank having a relatively flat cone on one end thereof, said cone presenting an uninterrupted surface and having a cone angle of between 124° and 140° ;

placing said prepared cylindrical blank within a cylindrical bore having substantially the same diameter as the external diameter of said blank, the lower end of said bore receiving mandrel means, and said blank being placed so that the end thereof opposite to said one end is resting on said mandrel means, and so that the blank is confined over its full height by the sidewall of said cylindrical bore;

inserting a punch into the upper end of said cylindrical bore, said punch having a cross-slotted matrix on the lower end thereof;

pressing said punch downwardly against said cone in a single stage cold forming operation, to deform said cone and fill said cross-slotted matrix whereby to form a desired cross-shaped configuration on said one end of said cylindrical blank;

removing said punch from said bore; and moving said mandrel means upwardly within said bore, to eject said cylindrical blank therefrom.

2. A method of producing a cross-slotted heading die as recited in claim 1, wherein during said pressing step said punch is moved toward said cylindrical blank at a pressing speed of from 4 mm/sec. to 4.5 mm/sec.

* * * * *